US009688428B2

(12) United States Patent
Liu

(10) Patent No.: US 9,688,428 B2
(45) **Date of Patent: *Jun. 27, 2017**

(54) STRETCH WRAPPING MACHINE STRUCTURE

(71) Applicant: Jun-Kui Liu, Dounan Township, Yunlin County (TW)

(72) Inventor: Jun-Kui Liu, Dounan Township, Yunlin County (TW)

( * ) Notice: Subject to any disclaimer, the term of this patent is extended or adjusted under 35 U.S.C. 154(b) by 481 days.

This patent is subject to a terminal disclaimer.

(21) Appl. No.: 14/257,036

(22) Filed: Apr. 21, 2014

(65) Prior Publication Data

US 2015/0298836 A1 Oct. 22, 2015

(51) Int. Cl.

| | |
|---|---|
| ***B65B 51/14*** | (2006.01) |
| ***B65B 11/04*** | (2006.01) |
| ***B65B 11/58*** | (2006.01) |
| ***B65B 11/00*** | (2006.01) |
| ***B65B 61/10*** | (2006.01) |

(52) U.S. Cl.

CPC ..... *B65B 11/045* (2013.01); *B65B 61/10* (2013.01)

(58) Field of Classification Search

CPC ..... B65B 61/06; B65B 11/04; B65B 51/10; B65B 11/045

USPC ..... 53/556

See application file for complete search history.

(56) References Cited

U.S. PATENT DOCUMENTS 4,619,102 A * 10/1986 Geisinger ..... B65B 11/045 53/399

5,450,709 A * 9/1995 Steding ..... B65B 11/025 53/210

* cited by examiner

*Primary Examiner* — Hemant M Desai
*Assistant Examiner* — Mary Hibbert
(74) *Attorney, Agent, or Firm* — Winston Hsu

(57) ABSTRACT

A stretch wrapping machine structure contains: a rotary disc including a column on which a guide way is arranged; an abutting plate including a rotating stem and a pushing portion adjacent to the rotating stem; a hot pressing sheet including a cutter seat, a driven bar, and a press segment; a holder including a V-shaped cross section and formed in a plate shape, the holder also including an actuation member, an actuating post, an operating segment, and a third cylinder; a biasing rod including a driving peg and a push segment; a controlling unit secured on a predetermined position of one side of the column; an air blowing unit located at a predetermined position of the holder. Thereby, an object is held on the rotary disc and is packed by a plastic film quickly and easily.

3 Claims, 12 Drawing Sheets

STRETCH WRAPPING MACHINE STRUCTURE

BACKGROUND OF THE INVENTION

Field of the Invention

The present invention relates to a stretch wrapping machine, and more particularly to a stretch wrapping machine structure which wraps and packs an object automatically by using a plastic film.

Description of the Prior Art

A conventional pallet packing machine has defects as follows:

1. A plastic film is manually adhered on a bottom end of an object by an operator, and after a rotary disc is rotated one or two cycles by an operator, the plastic film is positioned behind the object, and then the plastic film is released by the operator so that a holder is moved vertically, thereby wrapping the object by ways of the plastic film. Because of the object of various types and heights, the plastic film is wrapped more than or less than a top end of the object, thus packing the object overly or incompletely.

2. After the plastic film is wrapped on the object, the operator holds a cutting tool for cutting the plastic film manually, and then the plastic film is adhered on the object, thereby packing the object troublesomely.

3. The holder is driven by a screw rod in the column to move vertically, thus causing noises and moving slowly while the screw rod operates. For example, when threads of the screw rod wear, the holder vibrates greatly to make noises. Furthermore, in repair or maintenance, a driving member is removed from the screw rod inconveniently. Also, the holder and the plastic film move vertically, and the plastic film is pulled constantly to cause vibration, hence the plastic film wraps the object tightly or loosely.

4. The conventional pallet packing machine is not provided with a protection device, for instance, after the holder moves upwardly to a first dead point, it keeps an upward movement, and when the holder descends to a second dead point, it continues moving downwardly, thereby damaging the pallet packing machine easily.

The present invention has arisen to mitigate and/or obviate the afore-described disadvantages.

SUMMARY OF THE INVENTION

The primary objective of the present invention is to provide a stretch wrapping machine structure which is capable of overcoming the shortcomings of the conventional stretch wrapping machine structure.

Another objective of the present invention is to provide a stretch wrapping machine structure which wraps and packs an object automatically by using a plastic film.

To obtain the above objectives, a stretch wrapping machine structure provided by the present invention contains:

a rotary disc including a column on which a guide way is arranged so that a stretch wrapping machine longitudinally moves along the guide way on the column;

an abutting plate disposed on a first predetermined position of the rotary disc and including a rack, wherein the rack has a slidable groove in which a guiding rail is defined, the guiding rail is arranged at a predetermined position of the abutting plate, and the rack has an extending section extending outwardly from one side thereof, the extending section has a sliding mount slidably fixed thereon and coupling with a first end of a connecting sheet, the connecting sheet has a sliding block mounted on a second end thereof, and the sliding block has a rail stand fixed thereon opposite to a second predetermined position of the rotary disc;

a hot pressing sheet disposed on a third predetermined position of the rotary disc and located proximate to the abutting plate, the hot pressing sheet including a cutter seat mounted on one side thereof, a driven bar fixed on a distal end thereof and located at a fourth predetermined position of the rotary disc, and a press segment secured thereon adjacent to the driven bar and driven by a second cylinder, such that the hot pressing sheet is driven by the driven bar to swing vertically or horizontally, wherein one end of the second cylinder is located at a fifth predetermined position of the rotary disc;

a holder secured at a sixth predetermined position of the rotary disc and located proximate to the hot pressing sheet, the holder including a V-shaped cross section and being formed in a plate shape, the holder also including an actuation member disposed at a first predetermined position of a back surface thereof, an actuating post mounted on a distal end of the actuation member and located at an seventh predetermined position of the rotary disc, an operating segment fixed on the holder adjacent to the actuating post, a third cylinder used to drive the operating segment, such that the holder is driven to swing vertically or horizontally, wherein the third cylinder is located at an eighth predetermined position of the rotary disc; and the holder further includes an accommodating pedestal secured at a second predetermined position of the back surface thereof;

a biasing rod located at a ninth predetermined position of the rotary disc and operating relative to the accommodating pedestal, wherein the biasing rod includes a driving peg disposed on a distal end thereof and located at a tenth predetermined position of the rotary disc, a push segment mounted thereon adjacent to the driving peg and driven by a fourth cylinder, such that the biasing rod is driven to swing vertically or horizontally, wherein one end of the fourth cylinder is fixed on an eleventh predetermined position of the rotary disc;

a controlling unit secured on a predetermined position of one side of the column;

an air blowing unit located at a predetermined position of the holder.

Thereby, the plastic film is pulled by the pulling shaft of the stretch wrapping machine and its free end is retained by the holder and the biasing rod, and the rotary disc rotates the object, the plastic film wraps the object rotatably and repeatedly. The abutting plate and the holder swing vertically and are wrapped by the plastic film, then the hot pressing sheet, the cutter seat and the biasing rod are swung and positioned so that the hot pressing sheet hotly seals the plastic film relative to the abutting plate, and the cutter seat cuts the free end of the plastic film, thus packing the object. In other words, the object is packed by the plastic film quickly and easily.

DETAILED DESCRIPTION OF THE PREFERRED EMBODIMENTS

The present invention will be clearer from the following description when viewed together with the accompanying drawings, which show, for purpose of illustrations only, a first embodiment in accordance with the present invention.

Figure 1:
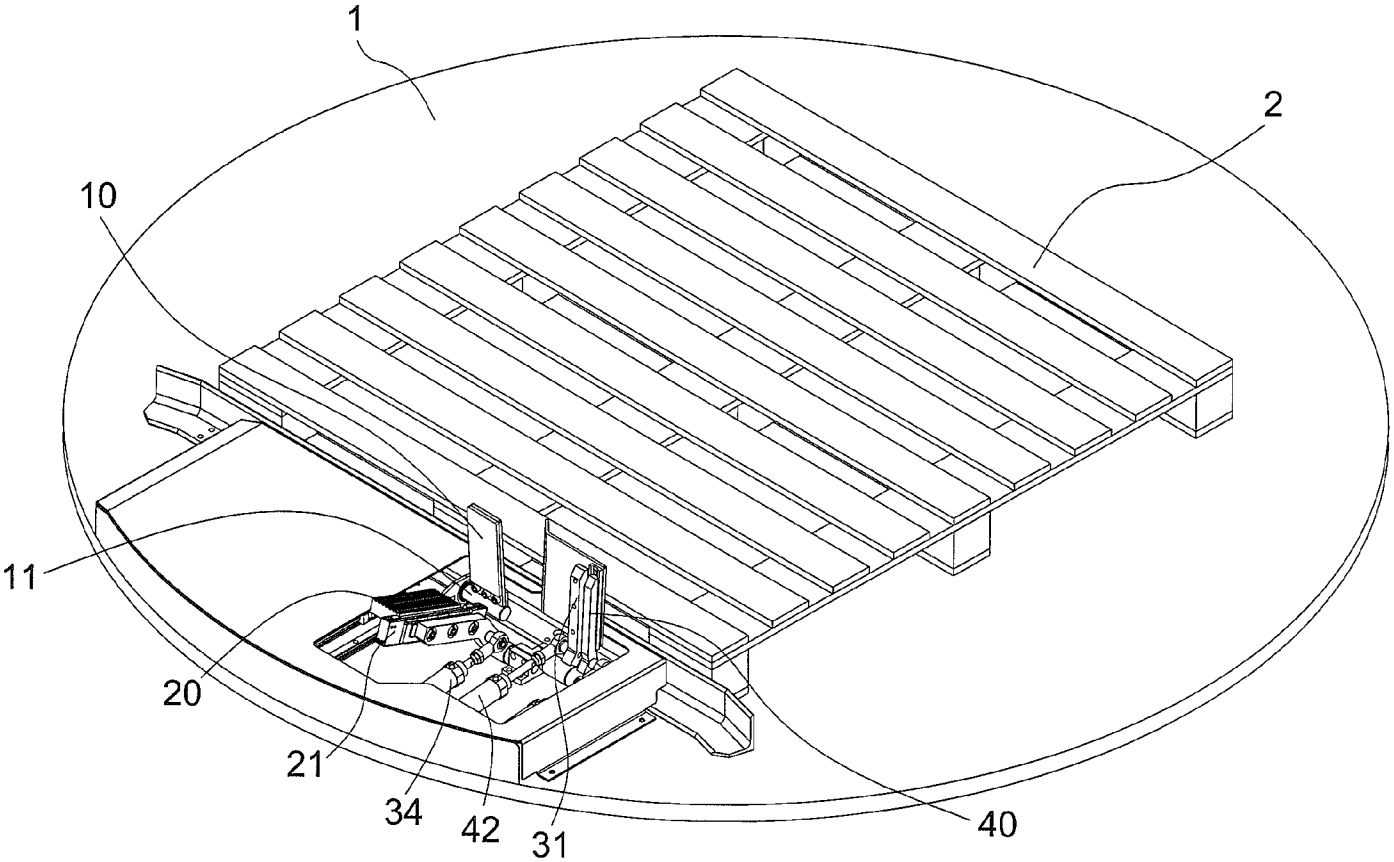
FIG. 1 is a perspective view showing the assembly of a stretch wrapping machine structure according to a preferred embodiment of the present invention.
Figure 2:
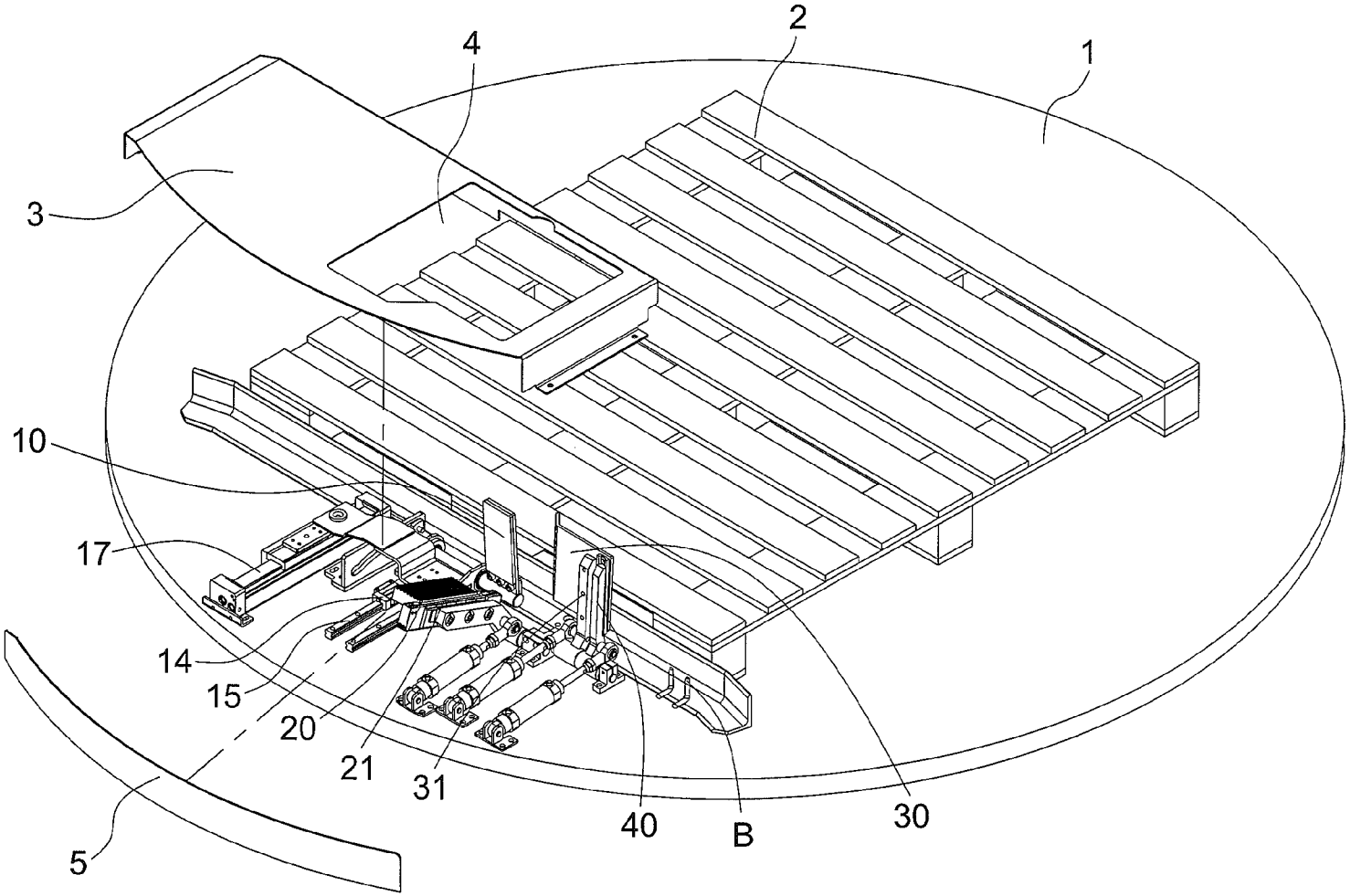
FIG. 2 is a perspective view showing the exploded components of the stretch wrapping machine structure according to the preferred embodiment of the present invention.
Figure 3:
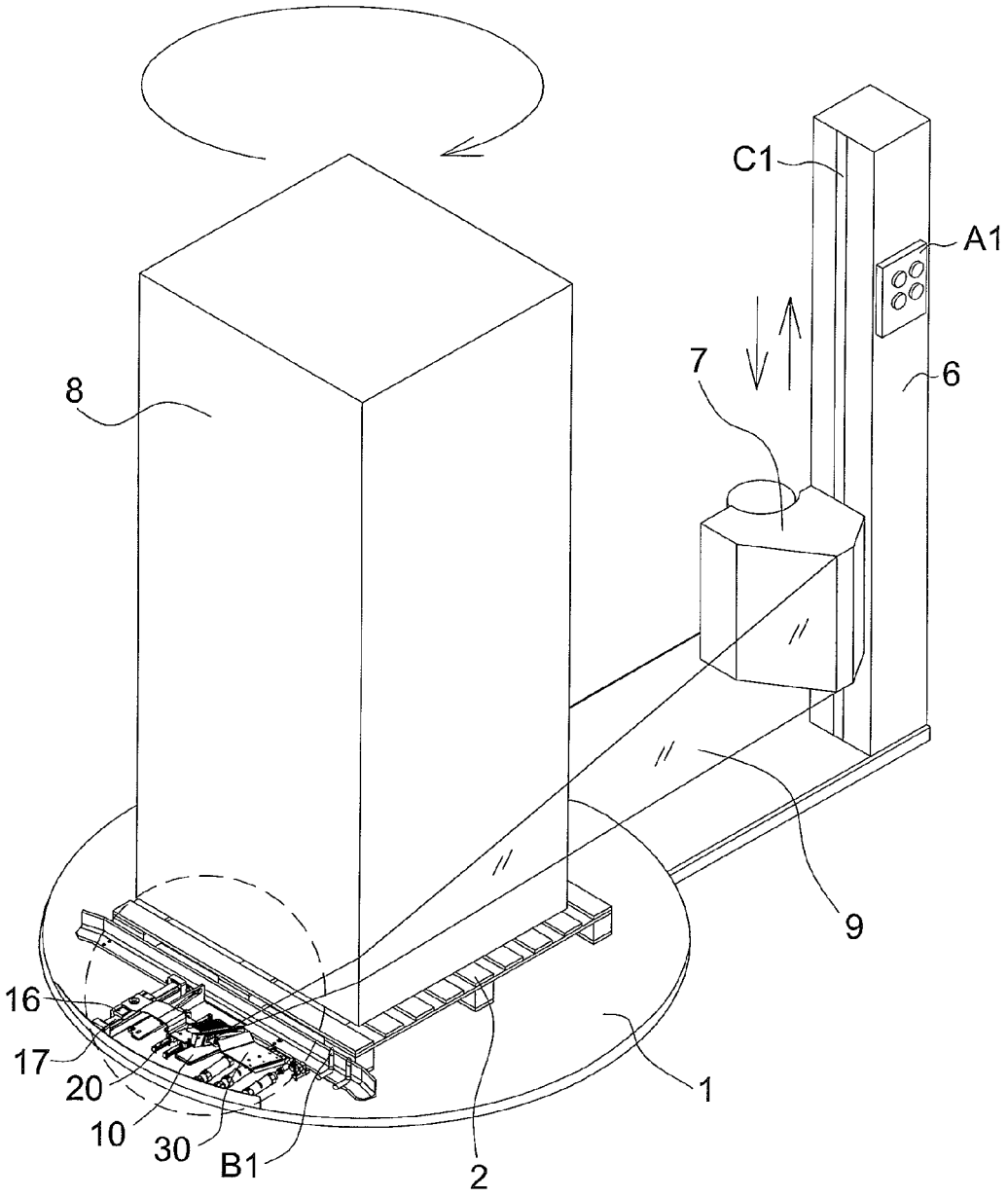
FIG. 3 is another perspective view showing the assembly of the stretch wrapping machine structure according to the preferred embodiment of the present invention.
Figure 4:
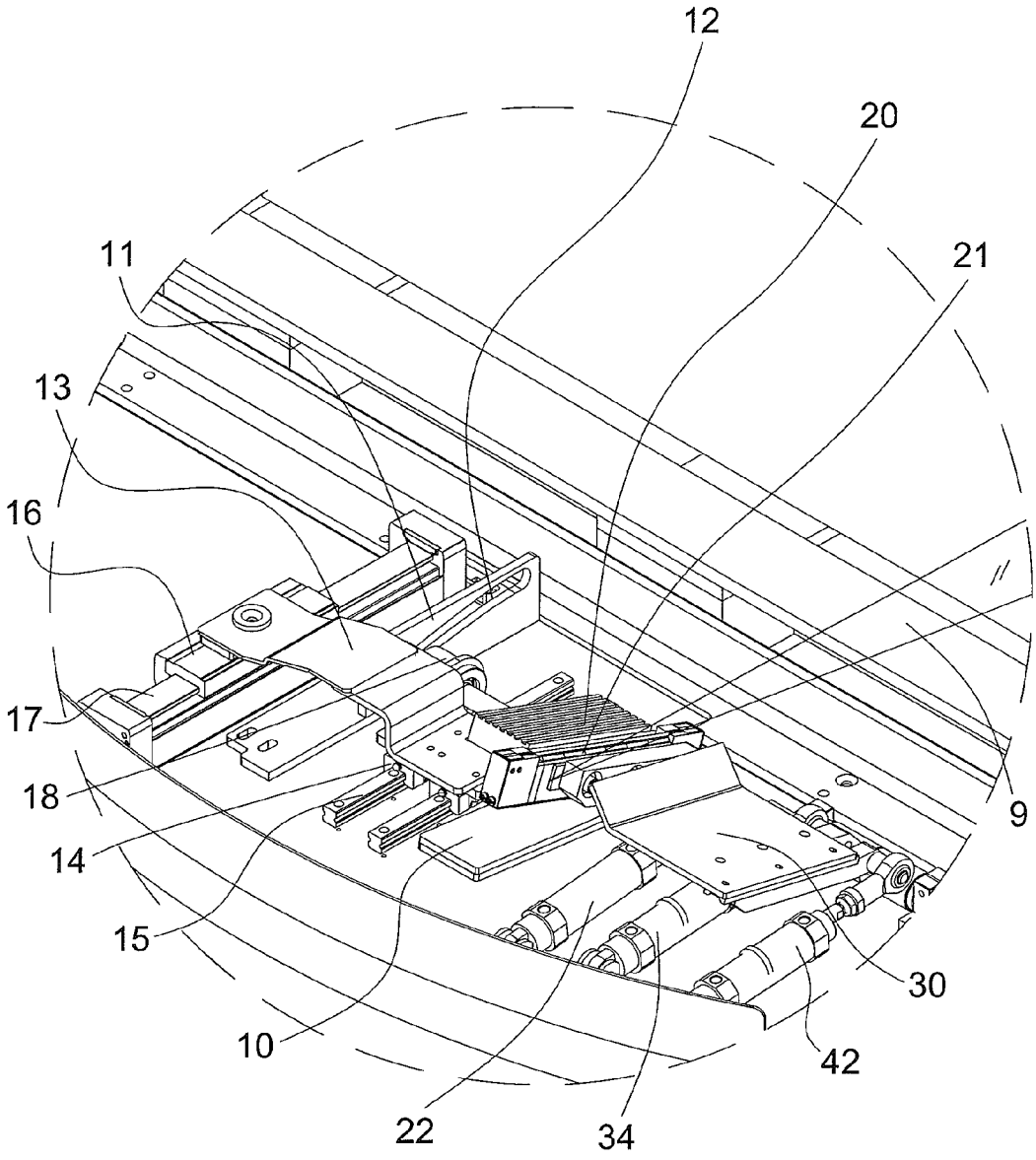
FIG. 4 is an amplified perspective view of a part of FIG. 3.
Figure 5:
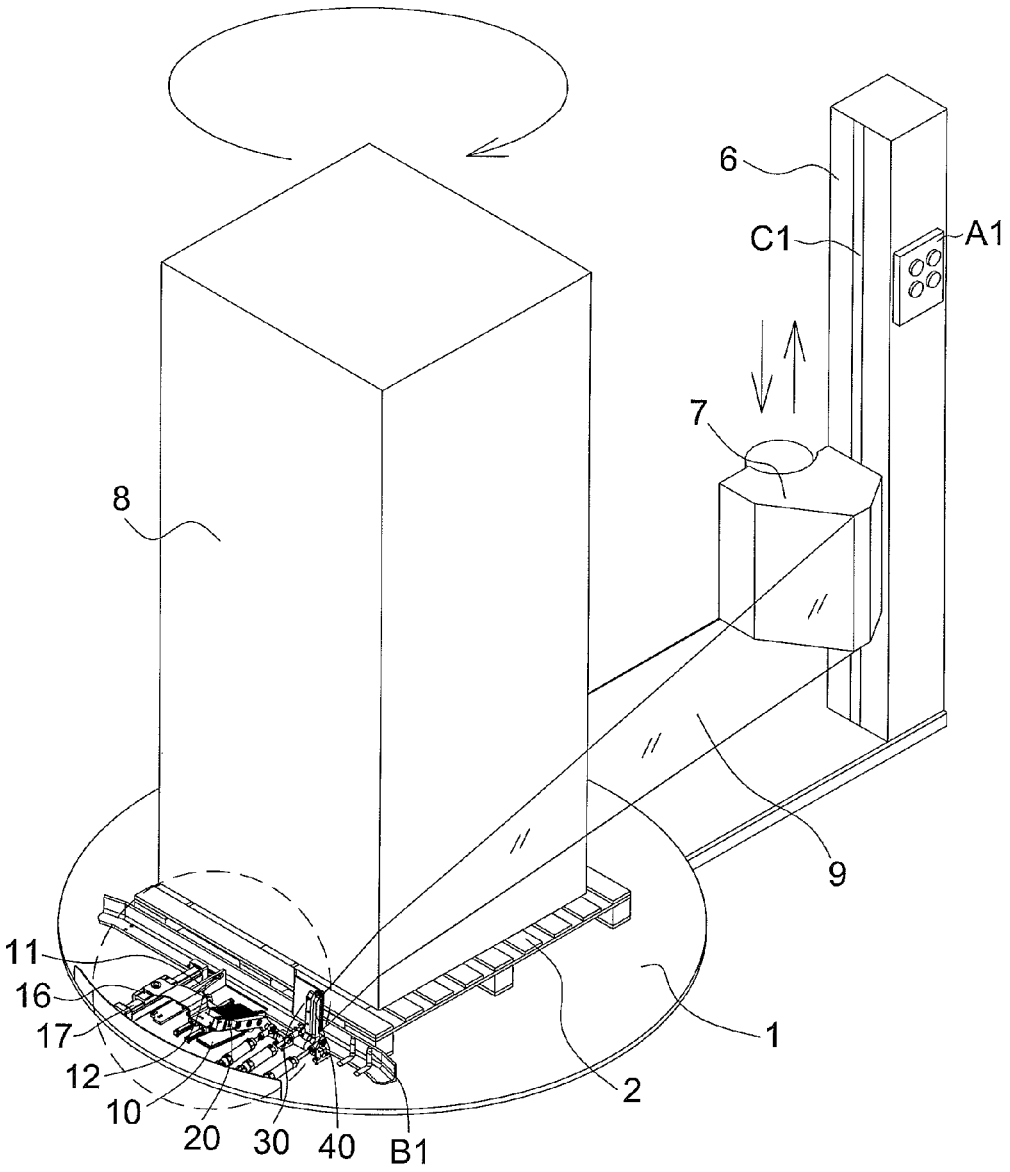
FIG. 5 is a perspective view showing the operation of the stretch wrapping machine structure according to the preferred embodiment of the present invention.
Figure 6:
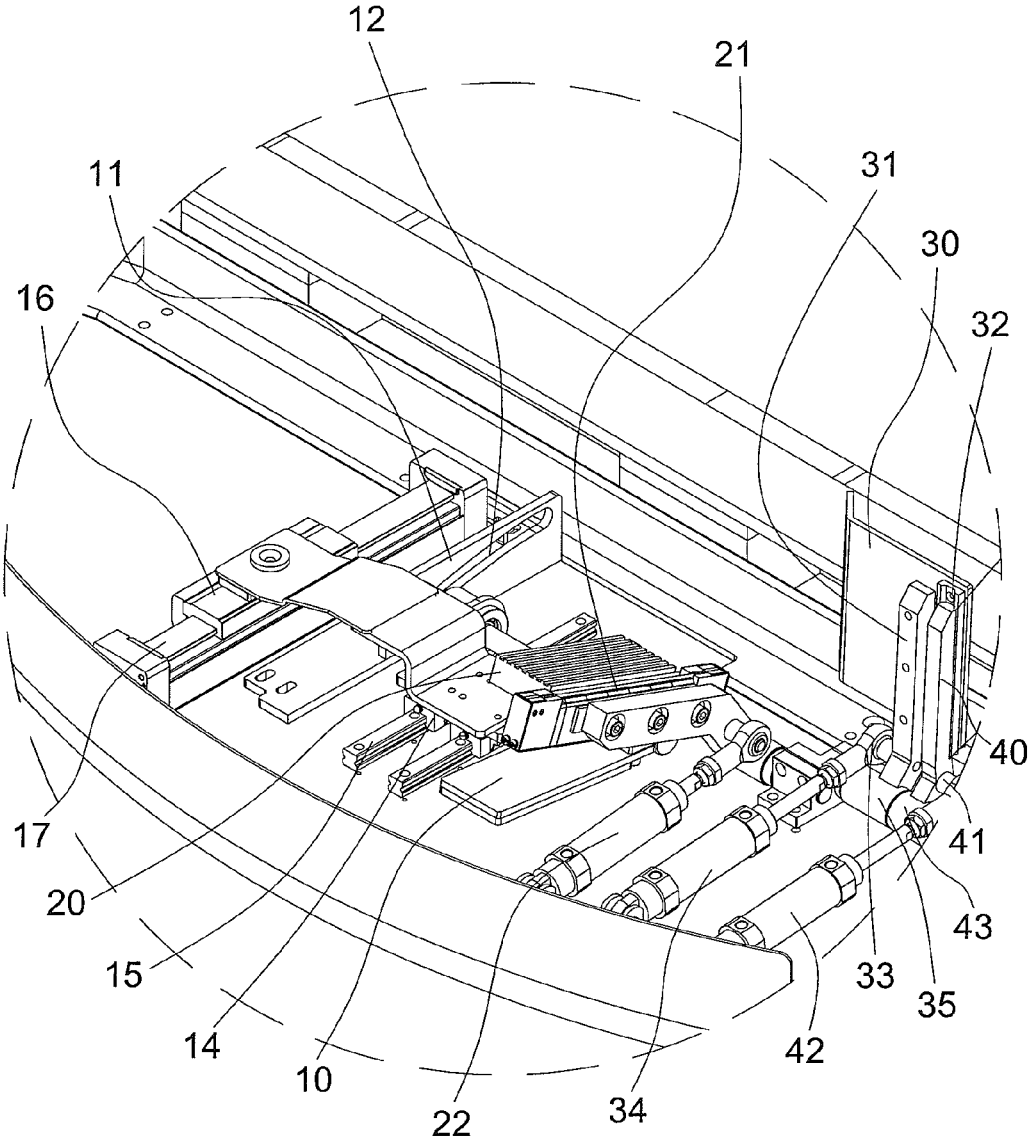
FIG. 6 is an amplified perspective view of a part of FIG. 5.
Figure 7:
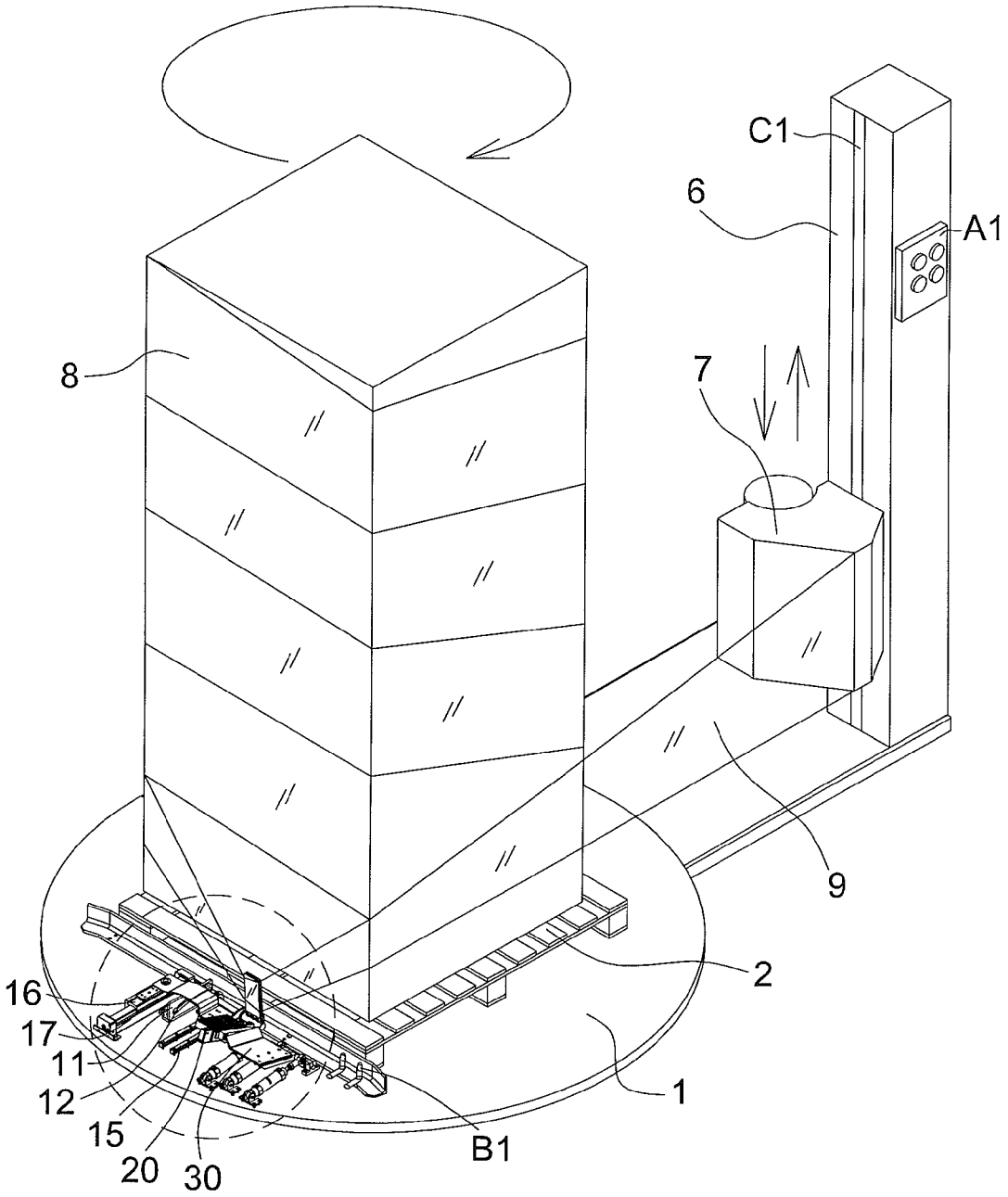
FIG. 7 is another perspective view showing the operation of the stretch wrapping machine structure according to the preferred embodiment of the present invention.
Figure 8:
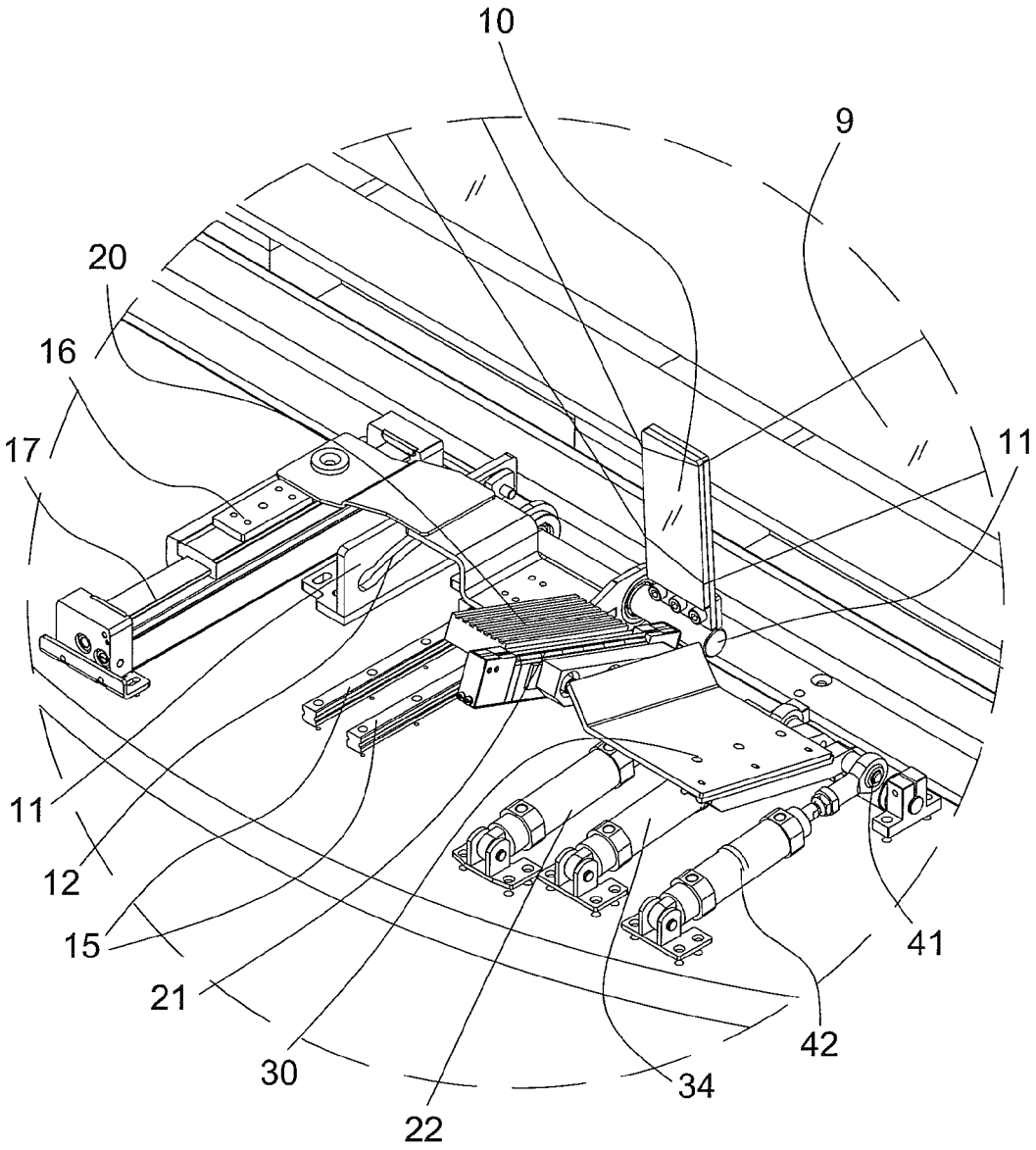
FIG. 8 is an amplified perspective view of a part of FIG. 7.
Figure 9:
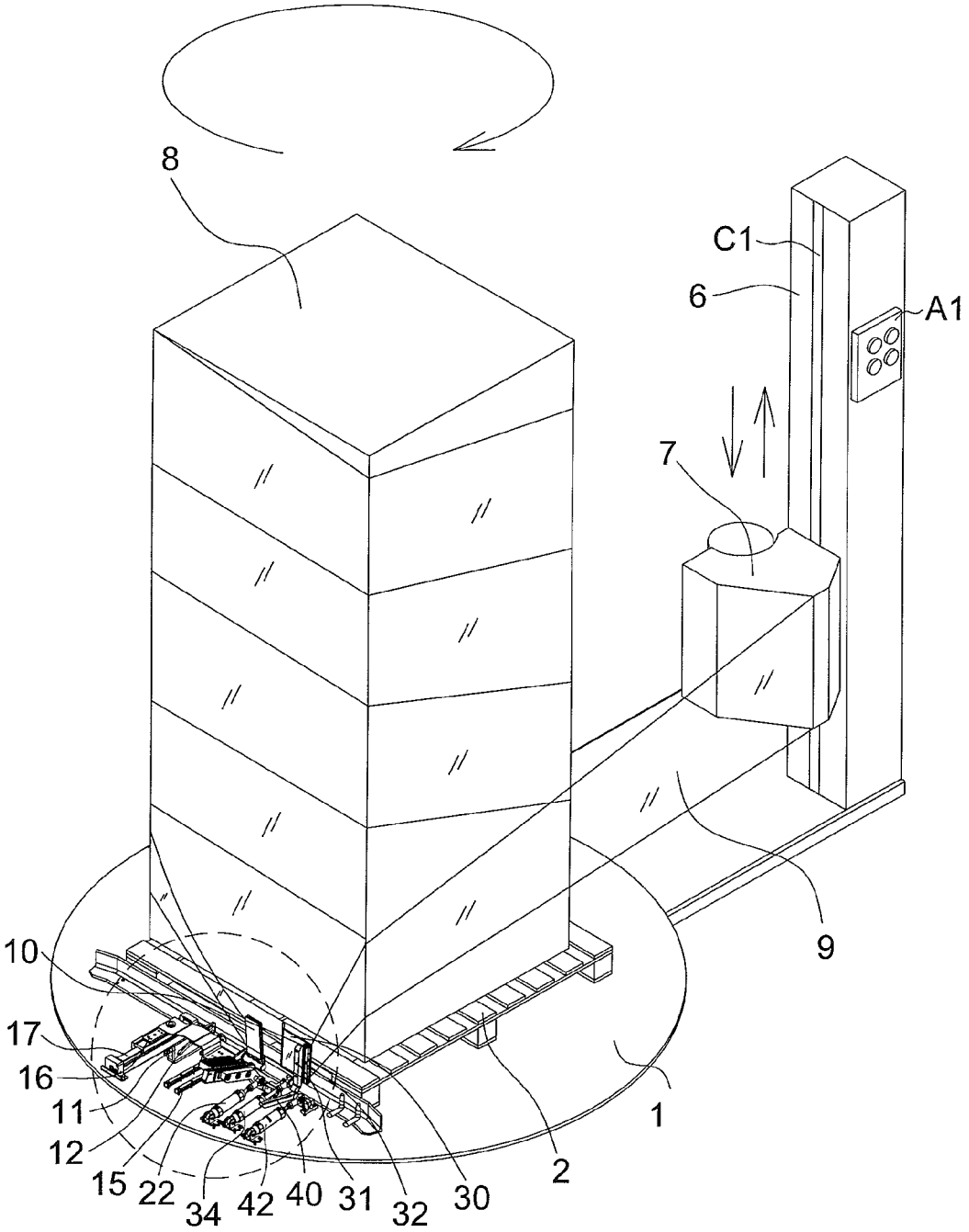
FIG. 9 is also another perspective view showing the operation of the stretch wrapping machine structure according to the preferred embodiment of the present invention.
Figure 10:
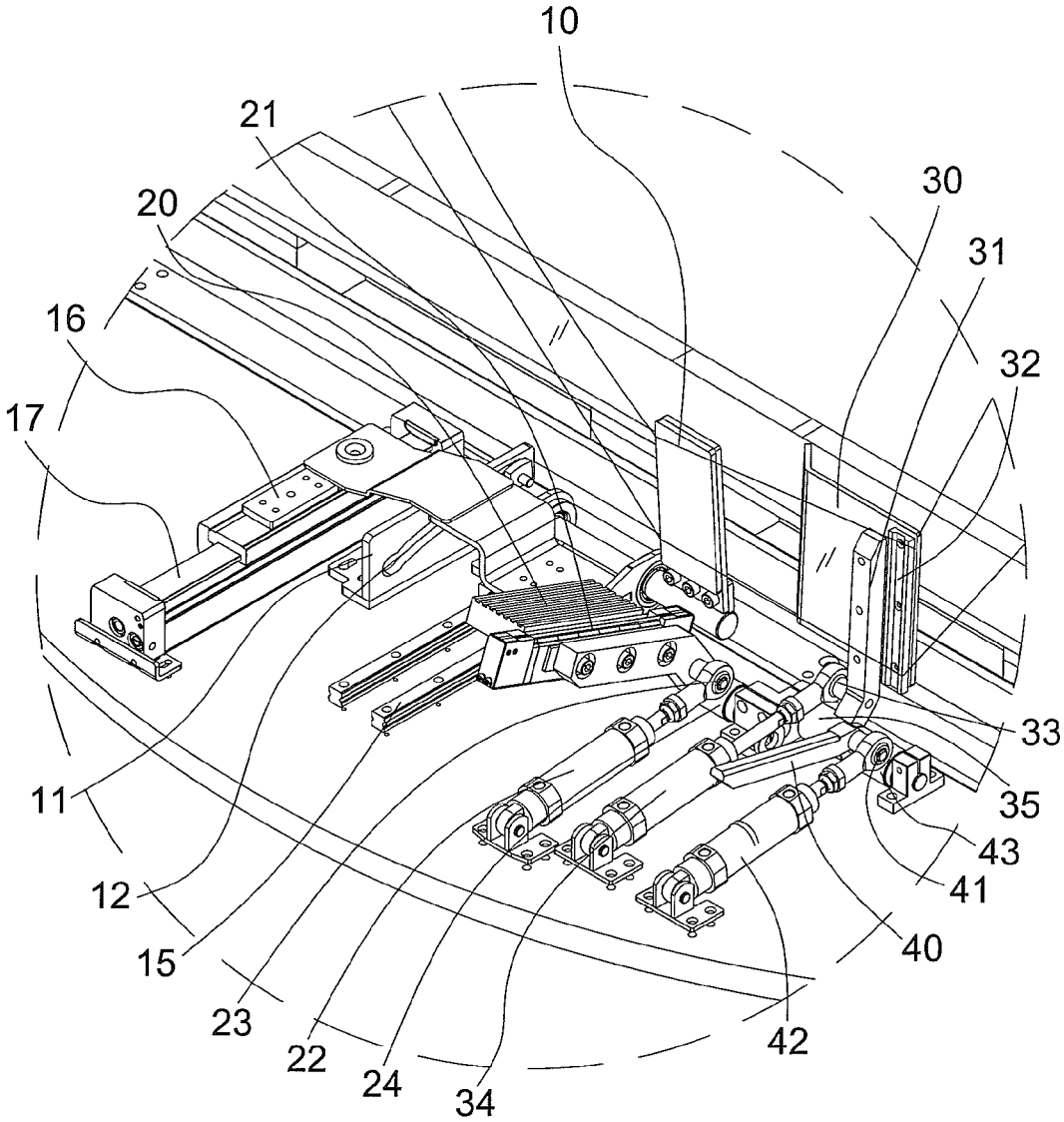
FIG. 10 is an amplified perspective view of a part of FIG. 9.
Figure 11:
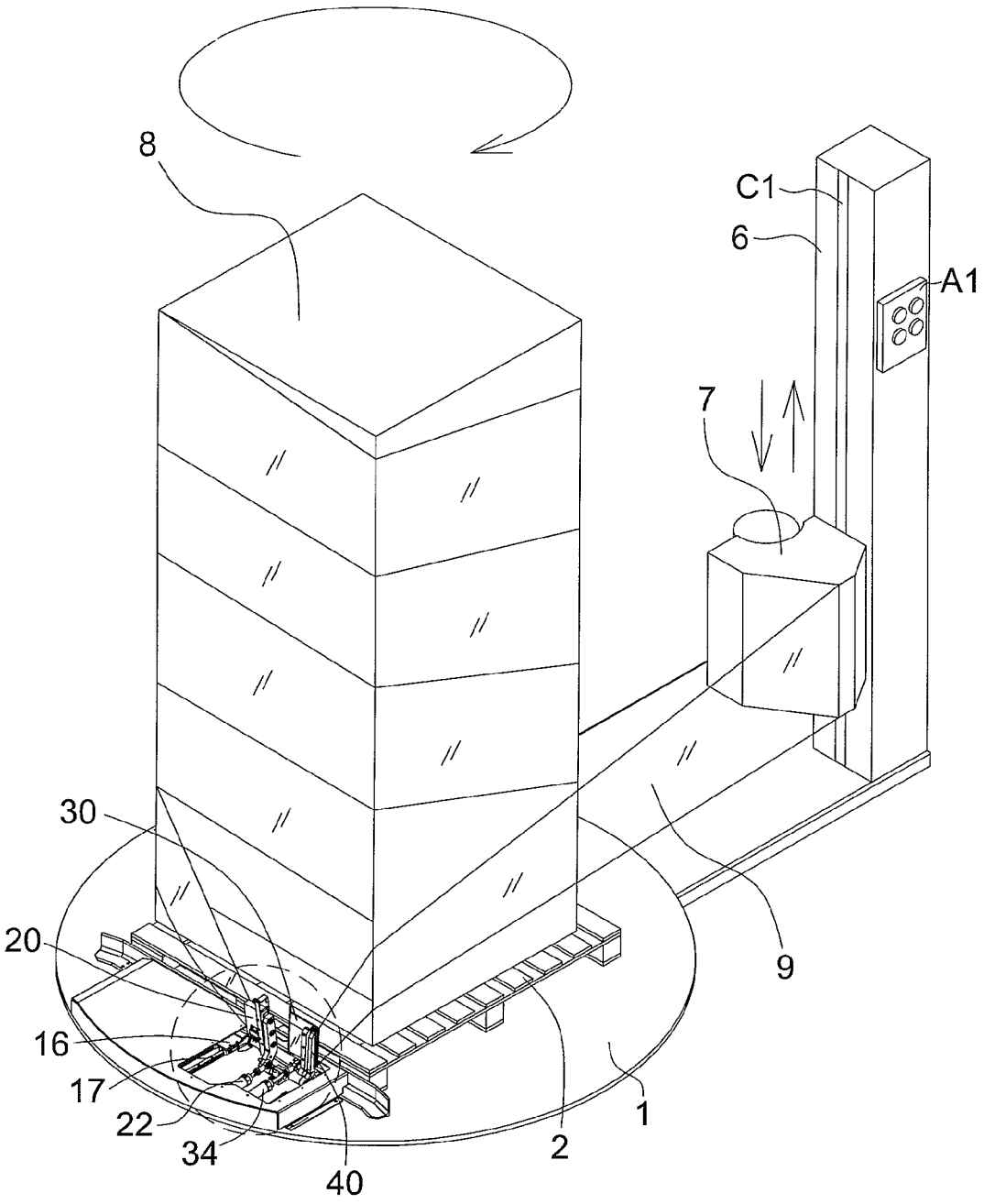
FIG. 11 is still another perspective view showing the operation of the stretch wrapping machine structure according to the preferred embodiment of the present invention.
Figure 12:
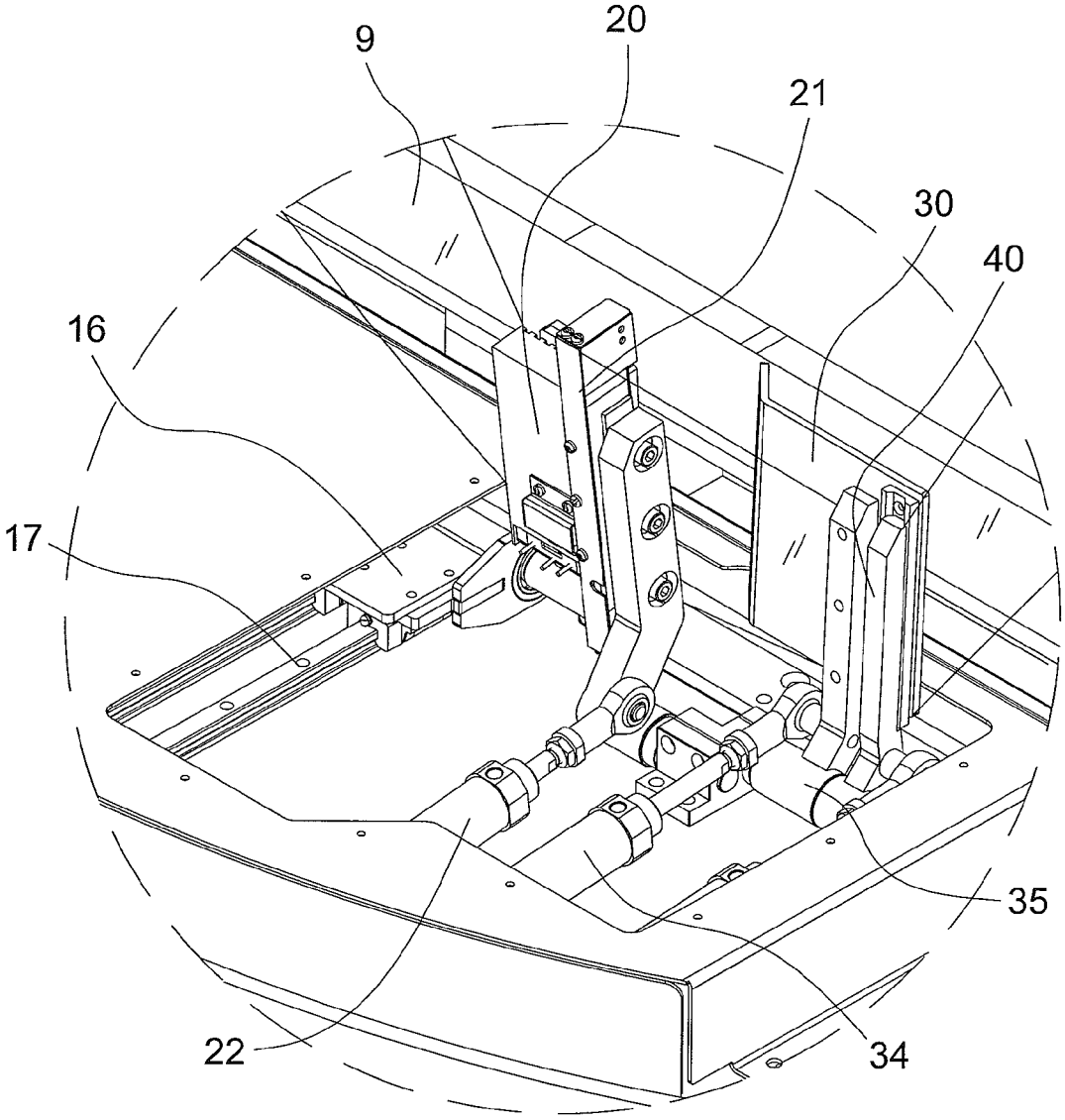
FIG. 12 is an amplified perspective view of a part of FIG. 11.

With reference to FIGS. 1-12, a stretch wrapping machine structure according to a preferred embodiment of the present invention comprises:

a rotary disc 1 controlled to rotate by a computer and including a column 6 on which a guide way C1 is arranged so that a stretch wrapping machine 7 longitudinally moves along the guide way C1 on the column 6, the stretch wrapping machine 7 being controlled to move vertically by a controlling unit A1; wherein the rotary disc 1 also includes a pallet 2 mounted thereon and used to hold an object 8; the stretch wrapping machine 7 has a plastic film 9 rolled thereon and pulled by a rolling shaft of the stretch wrapping machine 7;

an abutting plate 10 disposed on a first predetermined position of the rotary disc 1 and including a rack 11, wherein the rack 11 has a slidable groove 12 in which a guiding rail 18 is defined, the guiding rail 18 is arranged at a predetermined position of the abutting plate 10, and the rack 11 has an extending section 15 extending outwardly from one side thereof, the extending section 15 has a sliding mount 14 slidably fixed thereon and coupling with a first end of a connecting sheet 13, the connecting sheet 13 has a sliding block 16 mounted on a second end thereof, and the sliding block 16 has a rail stand 17 fixed thereon opposite to a second predetermined position of the rotary disc 1; the abutting plate 10 causes a vertical swing or a horizontal swing reversely by using the slidable groove 12 of the rack 11;

a hot pressing sheet 20 disposed on a third predetermined position of the rotary disc 1 and located proximate to the abutting plate 10, the hot pressing sheet 20 including a cutter seat 21 mounted on one side thereof, a driven bar 24 fixed on a distal end thereof and located at a fourth predetermined position of the rotary disc 1, and a press segment 23 secured thereon adjacent to the driven bar 24 and driven by a second cylinder 22, such that the hot pressing sheet 20 is driven by the driven bar 24 to swing vertically or horizontally, wherein one end of the second cylinder 22 is located at a fifth predetermined position of the rotary disc 1;

a holder 30 secured at a sixth predetermined position of the rotary disc 1 and located proximate to the hot pressing sheet 20, the holder 30 including a V-shaped cross section and being formed in a plate shape, the holder 30 also including an actuation member 31 disposed at a first predetermined position of a back surface thereof, an actuating post 35 mounted on a distal end of the actuation member 31 and located at a seventh predetermined position of the rotary disc 1, an operating segment 33 fixed on the holder 30 adjacent to the actuating post 35, a third cylinder 34 used to drive the operating segment 33, such that the holder 30 is driven to swing vertically or horizontally, wherein the third cylinder 34 is located at an eighth predetermined position of the rotary disc 1; and the holder 30 further includes an accommodating pedestal 32 secured at a second predetermined position of the back surface thereof;

a biasing rod 40 located at a ninth predetermined position of the rotary disc 1 and operating relative to the accommodating pedestal 32, wherein the biasing rod 40 includes a driving peg 43 disposed on a distal end thereof and located at a tenth predetermined position of the rotary disc 1, a push segment 41 mounted thereon adjacent to the driving peg 43 and driven by a fourth cylinder 42, such that the biasing rod 40 is driven to swing vertically or horizontally, wherein one end of the fourth cylinder 42 is fixed on an eleventh predetermined position of the rotary disc 1;

a cover 3 including a through portion 4 defined thereon and a side lid 5 formed on one side thereof and covering above-mentioned components;

the controlling unit A1 secured on a predetermined position of one side of the column 6 to control a vertical movement of the stretch wrapping machine 7, a rotation of the rotary disc 1, and a swing of the above-mentioned components;

an air blowing unit B1 located at a predetermined position of the holder 30 and applied to blow air so that the plastic film 9 adheres on the object 8 in a film wrapping process.

Thereby, the plastic film 9 is pulled by the pulling shaft of the stretch wrapping machine 7 and its free end is retained by the holder 30 and the biasing rod 40, and the rotary disc 1 rotates the object 8, the plastic film 9 wraps the object 8 rotatably and repeatedly. The abutting plate 10 and the holder 30 swing vertically and are wrapped by the plastic film 9, then the hot pressing sheet 20, the cutter seat 21 and the biasing rod 40 are swung and positioned so that the hot pressing sheet 20 hotly seals the plastic film 9 relative to the abutting plate 10, and the cutter seat 21 cuts the free end of the plastic film 9, thus packing the object. In other words, the object 8 is packed by the plastic film 9 quickly and easily.

While various embodiments in accordance with the present invention have been shown and described, it is clear to those skilled in the art that further embodiments may be made without departing from the scope of the present invention.

What is claimed is:

1. A stretch wrapping machine structure comprising:

a rotary disc including a column on which a guide way is arranged so that a stretch wrapping machine longitudinally moves along the guide way on the column;

an abutting plate disposed on a first predetermined position of the rotary disc and including a rack, wherein the rack has a slidable groove in which a guiding rail is defined, the guiding rail is arranged at a predetermined position of the abutting plate, and the rack has an extending section extending outwardly from one side thereof, the extending section has a sliding mount slidably fixed thereon and coupling with a first end of a connecting sheet, the connecting sheet has a sliding block mounted on a second end thereof, and the sliding block has a rail stand fixed thereon opposite to a second predetermined position of the rotary disc;

a hot pressing sheet disposed on a third predetermined position of the rotary disc and located proximate to the abutting plate, the hot pressing sheet including a cutter seat mounted on one side thereof, a driven bar fixed on a distal end thereof and located at a fourth predetermined position of the rotary disc, and a press segment secured thereon adjacent to the driven bar and driven by a second cylinder, such that the hot pressing sheet is driven by the driven bar to swing vertically or horizontally, wherein one end of the second cylinder is located at a fifth predetermined position of the rotary disc;

a holder secured at a sixth predetermined position of the rotary disc and located proximate to the hot pressing sheet, the holder including a V-shaped cross section and being formed in a plate shape, the holder also including an actuation member disposed at a first predetermined position of a back surface thereof, an actuating post mounted on a distal end of the actuation member and located at a seventh predetermined position of the rotary disc, an operating segment fixed on the holder adjacent to the actuating post, a third cylinder used to drive the operating segment, such that the holder is driven to swing vertically or horizontally, wherein the third cylinder is located at an eighth predetermined position of the rotary disc; and the holder further includes an accommodating pedestal secured at a second predetermined position of the back surface thereof;

a biasing rod located at a ninth predetermined position of the rotary disc and operating relative to the accommodating pedestal, wherein the biasing rod includes a driving peg disposed on a distal end thereof and located at a tenth predetermined position of the rotary disc, a push segment mounted thereon adjacent to the driving peg and driven by a fourth cylinder, such that the biasing rod is driven to swing vertically or horizontally, wherein one end of the fourth cylinder is fixed on an eleventh predetermined position of the rotary disc;

a controlling unit secured on a predetermined position of one side of the column; and an air blowing unit located at a predetermined position of the holder;

wherein when a plastic film is pulled by the stretch wrapping machine, a free end of the plastic film is retained by the holder and the biasing rod; and when the rotary disc rotates an object, the plastic film wraps the object, and the abutting plate and the holder swing vertically and are wrapped by the plastic film.

2. The stretch wrapping machine structure as claimed in claim 1, wherein the rotary disc also includes a pallet mounted thereon and used to hold the object.

3. The stretch wrapping machine structure as claimed in claim 1, wherein the plastic film is pulled by a rolling shaft of the stretch wrapping machine.

* * * * *